US005849449A

United States Patent [19]

Wilson

[11] Patent Number: 5,849,449

[45] Date of Patent: Dec. 15, 1998

[54] ELECTROSTATOGRAPHIC DEVELOPER HAVING TONER PARTICLES CONTAINING POLYMERS OF (2-CYANOACETAMIDO) PHENYL ACRYLATES POLYMERS

[75] Inventor: John C. Wilson, Rochester, N.Y.

[73] Assignee: Eastman Kodak Company, Rochester, N.Y.

[21] Appl. No.: 631,723

[22] Filed: Apr. 10, 1996

Related U.S. Application Data

[60] Provisional application No. 60/001,521 Jul. 26, 1995.

[51] Int. Cl.[6] ..... G03G 9/08

[52] U.S. Cl. ..... 430/109; 430/110

[58] Field of Search ..... 430/108, 109, 430/105, 110

[56] References Cited

U.S. PATENT DOCUMENTS

| | | | |
|---|---|---|---|
| 4,247,673 | 1/1981 | Ponticello et al. | 526/263 |
| 4,837,102 | 6/1989 | Dan | 430/114 |

*Primary Examiner*—Christopher Henderson
*Attorney, Agent, or Firm*—John R. Everett

[57] ABSTRACT

A (2-cyanoacetamido)phenyl acrylate monomer is disclosed. It is used to make polymers. The polymers are useful for making toners for electrostatographic developers.

4 Claims, No Drawings

ELECTROSTATOGRAPHIC DEVELOPER HAVING TONER PARTICLES CONTAINING POLYMERS OF (2-CYANOACETAMIDO) PHENYL ACRYLATES POLYMERS

CROSS REFERENCE TO RELATED APPLICATION

Reference is made to and priority claimed from U.S. Provisional Application Ser. No. 60/001,521, filed 26 Jul. 1995, entitled (2-CYANOACETAMIDO)PHENYL ACRYLATE MONOMERS AND POLYMERS.

FIELD OF THE INVENTION

The invention relates to novel compositions of matter and their use in thin films and electrostatographic toners and developers.

BACKGROUND OF THE INVENTION

The preparation of thermoset polymers at ambient temperatures continues to be of interest in the coatings industry and for other applications where enhanced physical properties are sought.

U.S. Pat. No. 4,247,673 (1981) (issued to Ponticello, et al., Eastman Kodak) discloses crosslinkable polymers of at least one polymerizable compound of the formula:

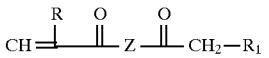

wherein R is hydrogen or methyl; $R_1$ is cyano or

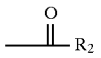

wherein $R_2$ is alkyl; Z is —X—$R_3$—X— or

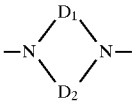

wherein each —X— is —O— or —$NR_4$—, provided at least one —X— is —$NR_4$—, wherein $R_4$ is hydrogen or alkyl, $R_3$ is divalent hydrocarbon and $D_1$ and $D_2$ together are the carbon atoms necessary to complete a 5 to 7 membered ring. However, the monomers reported, from which the polymers are made, are relatively difficult to make.

SUMMARY OF THE INVENTION

The invention provides novel (2-cyanoacetamido)phenyl acrylate monomers and polymers, including crosslinked polymers and copolymers, comprising repeating (2-cyanoacetamido)phenyl acrylate units.

The above U.S. Pat. No. 4,247,673 does not teach the synthesis of the monomers and polymers of (2-cyanoacetamido)phenyl acrylates.

DETAILED OF THE INVENTION

A portion of the (2-cyanoacetamido)phenyl acrylates of the invention have the formula (I):

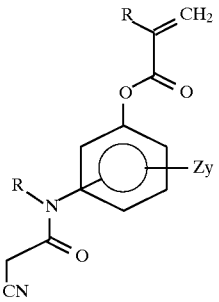

(I)

wherein

R represents H and alkyl and the 2-cyanoacetamido group is ortho, meta or para substituted on the phenyl ring relative to the acrylate group; and Z represents H, alkyl, alkoxy, halo, nitro, alkylsulfonyl, carboxyl, carboalkoxy, cyano, acyl, trihaloalkyl, and aryl; or Z represents sufficient carbon atoms, together with the phenyl ring to which it is attached, to form naphthyl; and y is an integer from 0 to 4.

Alkyl refers to groups such as methyl, ethyl and propyl. Z refers to groups such as methyl, ethyl, hydrogen, methoxy, ethoxy, chloro, bromo, fluoro, nitro, ethylsulfonyl, carbomethoxy, carboxyl, cyano, trifluoromethyl, phenyl and acetyl.

The polymers made from the above monomers have the formula (II):

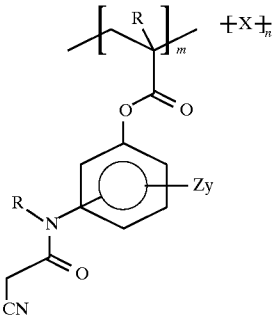

(II)

wherein

R, Z, and y have the definitions presented above;

X represents a polymerized vinyl monomer;

m is from 0.1 to 100 weight percent; and n is from 0 to 99.9 weight percent.

The molecular weight of useful polymers can vary over a wide range depending on the desired properties of, for an example, toners. Number average molecular weights from 1,000 to 1,000,000 will be useful.

The polymers and copolymers of the invention may be crosslinked under ambient conditions with aldehydes catalyzed by base. The chemistry of the crosslinking reaction using aldehydes is described in J. Chem. Soc. v 117-T2, 1920, page 1465. Other methods and reagents for crosslinking can be used. Such methods and reagents are known in the art.

Films cast from solutions of the polymers and copolymers containing aldehyde and basic catalyst crosslink during drying at room temperature.

The polymers and copolymers of the invention may be used to prepare electrophotographic toners. For example, copolymers of styrene, butyl acrylate and a monomer of the invention may be crosslinked with aldehydes with basic catalysis by an evaporative limited coalescence procedure. Melt compounding is considered to represent another useful toner preparative technique. Such crosslinking is known to minimize hot offset of toner to fusing substations during the fixing of toner to a receiver such as paper.

The monomers of formula (I) are prepared by a two step procedure. The appropriate aminophenol is first cyanoacetylated within 1-cyanoacetyl-3,5-dimethylpyrazole by the general procedure described by Ried and Schleimer, Annalen 626, 98 (1959). The resultant (2-cyanoacetamido) phenol is then acylated with the appropriate alkacrylic anhydride in pyridine/THF with 4-dimethylaminopyridine acylation catalyst. The following reaction scheme illustrates this process.

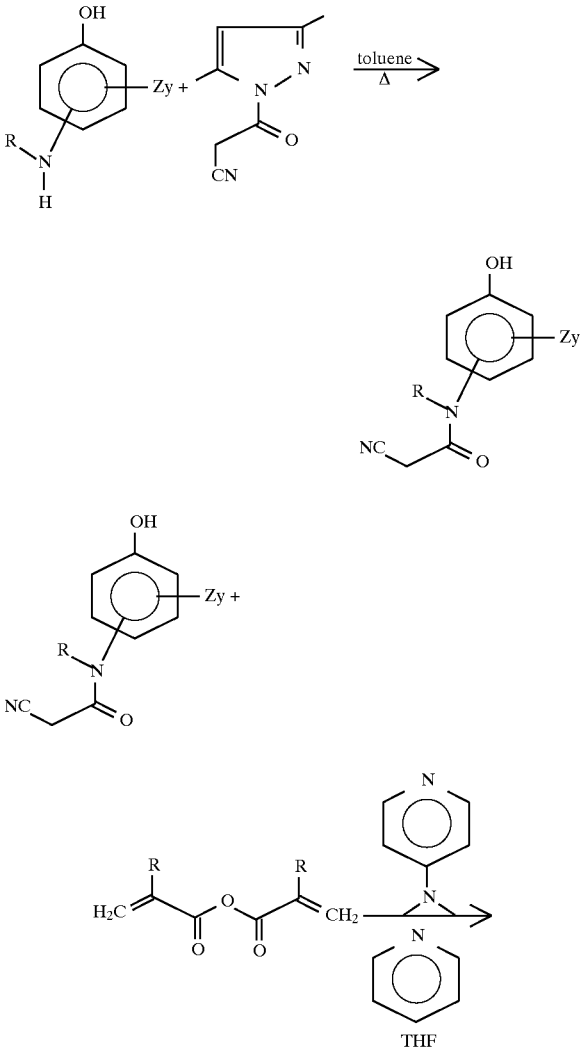

-continued

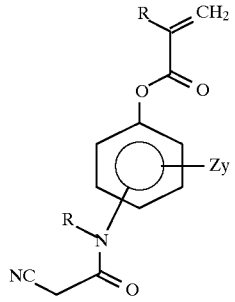

(I)

The polymers and copolymers of the invention were prepared by free radical initiation in solution. Bulk, emulsion and suspension processes are alternate procedures which may be employed to prepare the polymers and copolymers of the invention. These procedures are well known in the polymerization arts.

Although the use of base catalyzed reaction with aldehydes is the preferred mode of crosslinking, alternate crosslinking reagents known to readily react with active methylene such as metal ions, diamines, polyepoxides and divinyl compounds are considered to fall within the scope of the invention.

X, the polymerizable vinyl monomer, typically contains at least one —CH=C< or $CH_2$=C< radical. Exemplary monomers include, for example, vinyl esters, e.g. vinyl acetate, vinyl butyrate, etc.; vinyl amides, e.g. acrylamide, methacrylamide, N-methylacrylamide, N-isopropylmethacrylamide, etc.; vinyl nitriles, e.g. acrylonitrile, methacrylonitrile, 3-butenenitrile, etc.; vinyl ketones, e.g. methyl vinyl ketone, etc.; vinyl halides, e.g. vinyl chloride, vinyl bromide, vinylidene chloride, etc.; vinyl ethers, e.g. allyl methyl ether, allyl phenyl ether, 2-chlorovinyl methyl ether, etc.; alpha-beta-unsaturated acids or esters thereof, e.g. acrylic acid, methacrylic acid, methyl acrylate, butyl methacrylate, 2-dimethylaminoethyl methacrylate, 2-ethylhexyl acrylate, 2-hydroxyethyl methacrylate, etc.; olefins and diolefins, e.g. ethylene, propylene, butadiene, isoprene, 1,1-diphenylethylene, etc.; vinyl aromatics, e.g. styrene, α-methylstyrene, p-chlorostyrene, etc.; N-vinylsuccinamide; N-vinylphthalimide; N-vinylpyrazolidone; and others known in the art.

Preferably, the polymers of this invention are prepared from about 2 to about 30 percent, by weight, of at least one compound of formula (I) copolymerized with about 70 to about 98 percent, by weight, of at least one additional ethylenically unsaturated polymerizable monomer (X).

EXAMPLES

Example 1

3-(2-Cyanoacetamido)phenyl Methacrylate

A mixture of 10.91 g (0.10 mol) of m-aminophenol, 16.32 g (0.10 mol) of 1-cyanoacetyl-3,5-dimethylpyrazole and 200 ml of toluene was heated. A voluminous precipitate was formed requiring the addition of another 200 ml of toluene. The mixture was stirred and heated on a steam bath for 35 minutes and cooled. The white solid precipitate was collected, washed with toluene and then with ligroine and dried (mp=180°–1° C.).

Anal. Calcd. for $C_9H_8N_2O_2$: C, 61.36; H, 4.58; N, 15.90; Found: C, 61.47; H, 4.69; N, 15.92;

A solution of 17.62 g (0.10 mol) of 3-(2-cyanoacetamido) phenol, 18.50 g (0.12 mol) of methacrylic anhydride, 23.73 g (0.30 mol) of pyridine and 150 ml of tetrahydrofuran was prepared to which was added 1.22 g (0.01 mol) of 4-dimethylaminopyridine. A mild exotherm ensued and the reaction mixture was stirred at room temperature for 18 hours. 4-t-Butylpyrocatechol was added and the reaction mixture was concentrated to ½ volume. The concentrate was poured into dilute HCl and the solid precipitate was collected, washed with water and recrystallized from isopropanol. The product was collected, washed with isopropanol and ligroine and dried at reduced pressure at 600° C. (mp=158°–61° C.).

Anal. Calcd. for $C_{13}H_{12}N_2O_3$: C, 63.93; H, 4.95; N, 11.47; Found: C, 63.48; H, 5.09; N, 11.44;

Example 2

4-(2-Cyanoacetamido)phenyl Methacrylate

A mixture of 10.91 g (0.10 mol) of p-aminophenol, 16.32 g (0.10 mol) of 1-cyanoacetyl-3,5-dimethylpyrazole and 400 ml of toluene was heated on a steam bath for 1 hr. and cooled. The white product was collected, washed with toluene and ligroine and dried (mp=224 to 225.5° C.).

A mixture of 15.86 g (0.09 mol) of 4-(2-cyanoacetamido) phenol, 16.65 g (0.108 mol) of methacrylic anhydride, 21.36 g (0.27 mol) of pyridine and 135 ml of tetrahydrofuran was prepared to which was added 1.10 g (0.009 mol) of 4-dimethylaminopyridine. A mild exotherm was noted and the mixture was stirred for 22.5 hours. The mixture was poured into dilute HCl and the solid was collected, washed with water, methanol and ligroine. This material was recrystallized from acetonitrile, collected washed with ligroine and dried (mp=216.5°–18° C.).

Anal. Calcd. for $C_{13}H_{12}N_2O_3$: C, 63.93; H, 4.95; N, 11.47; Found: C, 63.93; H, 4.96; N, 11.40;

The above procedure was also used to make 2-(2-cyanoacetamido) phenyl methacrylate.

Example 3

4-(2-Cyanoacetamido)-3-methylphenyl Methacrylate

A mixture of 36.95 g (0.30 mol) of 4-amino-m-cresol, 48.95 g (0.30 mol) of 1-cyanoacetyl-3,5-dimethylpyrazole and 1200 ml of toluene was heated on a steam bath for 1 hr and cooled. The solid was collected, washed with toluene and then with ligroine and dried. The yield of crude material was 53.76 g. The crude material was recrystallized from ethanol (~200 ml of solution), collected, washed with a small amount of ethanol, then with ligroine and dried (mp=161.5°–2.0° C.)

Anal. Calcd. for $C_{10}H_{10}N_2O_2$: C, 63.15; H, 5.30; N, 14.73; Found: C, 63.18; H, 5.35; N, 14.76;

A solution of 38.04 g (0.20 mol) of 4-(2-cyanoacetamido) -3-methylphenol, 37.00 g (0.24 mol) of methacrylic anhydride, 47.46 g (0.60 mol) of pyridine and 300 ml of THF was treated with 2.44 g (0.02 mol) of 4-dimethylaminopyridine and stirred for 16 hours. The solution was poured into dilute HCl and the solid precipitate was collected, washed with water and recrystallized from isopropanol (300 ml of solution) with 4-t-butylpyrocatechol inhibitor. The solid was collected, washed with a small amount of isopropanol, then with ligroine and dried (mp=153°–40° C.).

Anal. Calcd. for $C_{14}H_{14}N_2O_3$: C, 65.1 1; H, 5.46; N, 10.85; Found: C, 65.29; H, 5.48; N, 10.85;

Example 4

Poly[3-(2-cyanoacetamido)phenyl methacrylate]

A solution of 10.00 g of 3-(2-cyanoacetamido)phenyl methacrylate and 90.00 g of N,N-dimethylformamide (DMF) was purged with nitrogen. 2,2'-azobis (2-methylpropionitrile) (AIBN) free radical initiator (0.05 g) was added and the solution was heated with nitrogen bubbling through the solution in a 60° C. bath for 17.67 hours. The polymer was precipitated in methanol, isolated, rinsed with methanol and redissolved in acetone (~50 ml of solution). The polymer was reprecipitated in methanol, collected, washed with methanol and dried at 60° C. at reduced pressure.

Anal. Calcd. for $C_{13}H_{12}N_2O_3$: C, 63.93; H, 4.95; N, 11.47; Found: C, 63.22; H, 5.00; N, 11.28;

IV(acetone)=0.25

Tg=147° C.

Example 5

Poly[4-(2-cyanoacetamido)phenyl methacrylate]

A solution of 10.00 g of 4-(2-cyanoacetamido)phenyl methacrylate and 90.00 g of DMF was purged with nitrogen. AIBN free radical initiator (0.05 g) was added and the solution was heated with nitrogen bubbling through the solution in a 60° C. bath for 18 hours. The polymer was precipitated in methanol, isolated, rinsed with methanol and redissolved in acetone (~50 ml of solution). The polymer was reprecipitated in methanol, collected, washed with methanol and dried at 60° C. at reduced pressure.

Anal. Calcd. for $C_{13}H_{12}N_2O_3$: C, 63.93; H, 4.95; N, 11.47; Found: C, 63.04; H, 4.96; N, 11.38;

IV(acetone)=0.21

Tg=192° C.

Poly[2-(2-cyanoacetamido)phenyl methacrylate] and poly[4-(2-cyanoacetamido)-3-methylphenyl methacrylate] were also prepared according to the above method.

Example 6

Copoly[3-(2-cyanoacetamido)phenyl methacrylate:methyl methacrylate] 10:90 (wt %)

A solution of 3.00 g (12.28 mmol) of 3-(2-cyanoacetamido)phenyl methacrylate, 27.00 g (269.68 mmol) of methyl methacrylate and 60.00 g of p-dioxane was purged with nitrogen in a 60° C. constant temperature bath. AIBN free radical initiator (0.15 g) was added and the solution was heated with nitrogen bubbling through the solution for 16.83 hours. The resultant viscous solution was diluted with an equal volume of p-dioxane and the polymer was precipitated in ether. The polymer was isolated, rinsed again with ether, collected and redissolved in methylene chloride (~200 ml of solution). The polymer was reprecipitated in ether, isolated, rinsed with ether and dried.

Anal. Calcd. for $C_{123}H_{187}N_2O_{47}$: C, 60.32; H, 7.74; N, 1.15; Found: C, 59.86; H, 7.46; N, 1.22;

IV(DCM)=0.45

Tg=115° C.

Example 7

Copoly[4-(2-cyanoacetamido)phenyl methacrylate:methyl methacrylate] 10:90 (wt %)

A solution of 3.00 g (12.28 mmol) of 4-(2-cyanoacetamido)phenyl methacrylate, 27.00 g (269.68 mmol) of methyl methacrylate and 60.00 g of p-dioxane was purged with nitrogen in a 60° C. constant temperature bath. AIBN free radical initiator (0.15 g) was added and the solution was heated with nitrogen bubbling through the solution for 19 hours. The resultant viscous solution was diluted with an equal volume of p-dioxane and the polymer was precipitated in ether. The polymer was isolated, rinsed again with ether, collected and redissolved in methylene chloride (~350 ml of solution) and filtered. The polymer was reprecipitated in ether, isolated, rinsed with ether and dried.

Anal. Calcd. for $C_{123}H_{187}N_2O_{47}$: C, 60.32; H,7.74; N, 1.15; Found: C, 60.22; H, 7.48; N, 1.41;

IV(DCM)=0.34

Tg=111° C.

Copoly[2-(2-cyanoacetamido)phenyl methacrylate:methyl methacrylate] 10:90 (wt %) was prepared by the above method.

Example 8

Copoly[3-(2-cyanoacetamido)phenyl methacrylate:styrene:butyl acrylate] 5:75:20 (wt %)

A solution of 75.00 g (720.12 mmol) of styrene, 20.00 g (156.04 mmol) of butyl acrylate, 5.00 g (20.47 mmol) of 3-(2-cyanoacetamido)phenyl methacrylate and 100.00 g of p-dioxane was purged with nitrogen in an 80° C. constant temperature bath. AIBN free radical initiator (0.25 g) was added and the solution was heated with nitrogen bubbling through the solution for 48.5 hours and cooled. The hazy solution was diluted to ~400 ml with p-dioxane and the polymer was precipitated in methanol. The polymer was isolated, rinsed again with methanol and redissolved in methylene chloride (~600 ml of solution) and filtered through diatomaceous earth. The polymer was reprecipitated in methanol with high speed stirring, collected and dried.

Anal. Calcd. for $C_{345}H_{382}N_2O_{18}$: C, 85.53; H, 7.95; N, 0.58; Found: C, 85.04; H, 7.77; N, 0.77;

IV(DCM)=0.75

Tg=67° C.

Example 9

Copoly[3-(2-cyanoacetamido)phenyl methacrylate:styrene:butyl acrylate] 10:70:20 (wt %)

A solution of 70.00 g (672.11 mmol) of styrene, 20.00 g (156.04 mmol) of butyl acrylate, 10.00 g (40.94 mmol) of 3-(2-cyanoacetamido)phenyl methacrylate and 100.00 g of p-dioxane was purged with nitrogen in an 80° C. constant temperature bath. AIBN free radical initiator (0.25 g) was added and the solution was heated with nitrogen bubbling through the solution for 22.17 hours and cooled. The solution was diluted with 100 ml of p-dioxane and the polymer was precipitated in methanol. The polymer was isolated, rinsed again with methanol and redissolved in methylene chloride (~400 ml of solution). The solution was filtered and the polymer was reprecipitated in methanol. The polymer was isolated, washed with methanol with high speed stirring, collected and dried.

Anal. Calcd. for $C_{1710}H_{1890}N_{20}O_{106}$: C, 81.59; H, 6.95; N, 1.15; Found: C, 83.49; H, 7.63; N, 1.60;

IV(DCM)=0.65

Tg=73° C.

Example 10

Crosslinking of Copoly[3-cyanoacetamidophenyl methacrylate:methyl methacrylate] 10:90 (wt %) with Butyraldehyde A solution of 2.50 g (1.02 mmol of 2-cyanoacetamido moiety) of copoly[3-(2-cyanoacetamido)phenyl methacrylate:methyl methacrylate] 10:90 (wt %) in 25 ml of methylene chloride was prepared. This solution was treated with 0.037 g (0.51 mmol) of butyraldehyde and 2 drops of diethylamine and stirred. Gelation was observed within 15 minutes at room temperature.

Example 1

Preparation of Crosslinked Film from Copoly[3-(2-cyanoacetamidophenyl methacrylate:methyl methacrylate] 10:90 (wt %) and Butyraldehyde Films were cast on Estar and Teflon supports from a solution prepared as described in the previous example with a 10 mil coating blade. Upon drying at room temperature a self supporting, methylene chloride insoluble film was removed from the Teflon support. The coating on Estar support adhered well.

Example 12

Crosslinking of Copoly[3-(2-cyanoacetamido) phenyl methacrylate:methyl methacrylate]10:90 (wt %) with Formaldehyde A solution of 2.50 g (1.02 mmol of 2-cyanoacetamido moiety) of copoly[3-(2-cyanoacetamido)phenyl methacrylate:methyl methacrylate] 10:90 (wt %) in 25 ml of acetone was prepared. This solution was treated with 3 drops (0.06 g) of 37% formaldehyde and 2 drops of diethylamine and stirred. Gelation was observed within 13 minutes at room temperature.

Example 13

Crosslinking of Copoly[4-(2-cyanoacetamido) phenyl methacrylate:methyl methacrylate]10:90 (wt %) with Butyraldehyde A solution of 2.50 g (1.02 mmol of 2-cyanocetamido moiety of copoly[4-(2-cyanoacetamido)phenyl methacrylate:methyl methacrylate] 10:90 (wt %) in 25 ml of methylene chloride was prepared. This solution was treated with 0.037 g (0.51 mmol) of butyraldehyde and 2 drops of diethylamine and stirred. Gelation was observed within 17 minutes at room temperature.

Example 14

Crosslinking of Copoly[3-(2-cyanoacetamido) phenyl methacrylate:styrene:butyl acrylate] 10:70:20 (wt %)

A solution of 1.22 g (0.50 mmol of 2-cyanoacetamido moiety) of copoly[3-(2-cyanoacetamido)phenyl methacrylate:styrene:butyl acrylate] 10:70:20 (wt %) in 4.88 g of ethyl acetate was prepared. The solution was treated with 0.02 g (0.27 mmol) of butyraldehyde and 1 drop of diethylamine and stirred. Gelation was observed within 3.5 minutes at room temperature.

In electrography, image charge patterns are formed on a support and are developed by treatment with an electrographic developer containing marking particles which are attracted to the charge patterns. These particles are called toner particles or, collectively, toner. Two major types of developers, dry and liquid, are employed in the development of the charge patterns.

In electrostatography, the image charge pattern, also referred to as an electrostatic latent image, is formed on an insulative surface of an electrostatographic element by any of a variety of methods. For example, the electrostatic latent image may be formed electrophotographically, by imagewise photo-induced dissipation of the strength of portions of an electrostatic field of uniform strength previously formed on the surface of an electrophotographic element comprising a photoconductive layer and an electrically conductive substrate. Alternatively, the electrostatic latent image may be formed by direct electrical formation of an electrostatic field pattern on a surface of a dielectric material.

One well-known type of electrostatographic developer comprises a dry mixture of toner particles and carrier particles. Developers of this type are employed in cascade and magnetic brush electrostatographic development processes. The toner particles and carrier particles differ triboelectrically, such that during mixing to form the developer, the toner particles acquire a charge of one polarity and the carrier particles acquire a charge of the opposite polarity. The opposite charges cause the toner particles to cling to the carrier particles. During development, the electrostatic forces of the latent image, sometimes in combination with an additional applied field, attract the toner particles. The toner particles are pulled away from the carrier particles and become electrostatically attached, in imagewise relation, to the latent image bearing surface. The resultant toner image can then be fixed, by application of heat or other known methods, depending upon the nature of the toner image and the surface, or can be transferred to another surface and then fixed.

Toner particles often include charge control agents, which, desirably, provide high uniform net electrical charge to toner particles without reducing the adhesion of the toner to paper or other medium. Example 16 below demonstrates the utility of (2-cyanoacetamido)phenyl acrylate polymers in toners for electrostatographic developers.

Example 15

Preparation of Crosslinked Clear Toner without Charge Control Agent by Evaporative Limited Coalescence from Copoly[3-(2-cyanoacetamido) phenyl methacrylate:styrene:butyl acrylate] 10:70:20 (wt %)

The "polymer suspension" technique where solid stabilizers of colloidal size are used to limit the coalescence of suspended droplets formed from polymers dissolved in a solvent as described in U.S. Pat. No. 5,133,992 was used to prepare polymer particles of the invention. In this process, a solution of the polymer described in Example 14 with butyraldehyde and diethylamine in ethyl acetate was dispersed as fine water-immiscible liquid droplets in water which contained a colloidal stabilizer. The suspension was stabilized by limiting the coalescence of the droplets as the solvent evaporated. The present invention advances this technology in that the dissolved polymer is crosslinked with butyraldehyde in the presence of diethylamine during the preparation of the polymer particles. The following description is illustrative of the process.

An organic phase comprised of a solution of 24.43 g of copoly[3-(2-cyanoacetamido)phenyl methacrylate:styrene:butyl acrylate] 10:70:20 (wt %), 0.36 g of butyraldehyde and 140.80 g of ethyl acetate was prepared. An aqueous phase comprised of 375 ml of pH 10 borate buffer, and 44 ml of a latex (3.0% solids) comprised of butyl methacrylate/ 2-hydroxyethyl methacrylate/ methacrylic acid/ ethylene dimethacrylate in a weight ratio of 58/30/5/7 was prepared. Diethylamine (0.05 g) was added to the organic phase and both phases were combined and homogenized in a high shear mixer and then sized at 40 psi and collected in a three neck flask. The mixture was stirred overnight with a nitrogen sweep allowing the ethyl acetate to evaporate. The mixture was further stirred for 30 minutes under water aspirator pressure. The mixture was filtered through a coarse screen and collected on a fine fritted funnel. The polymer particles were washed with distilled water until the washes were neutral and the conductivity was, 10 $\mu$S/cm. The yield of particles after drying was 20.7 g.

A sample of polymer particles was stirred in ethyl acetate whereby a substantial insoluble phase was observed relative to a control of polymer particles similarly prepared from styrene/butyl acrylate copolymer (Piccotoner 1221 available from Hercules) which did not contain the monomer residue of the present invention indicating that crosslinking of the polymer of the invention had occurred in the limited coalescence process.

Example 16

Preparation of Crosslinked Pigmented Toner with Charge Control Agent by Evaporative Limited Coalescence from Copoly[3-(2-cyanoacetamido) phenyl methacrylate:styrene:butyl acrylate] 10:70:20 (wt %)

This example describes the preparation of polymer particles by the limited coalescence technique described in the previous example but with pigment and charge control agent addenda. The charge control agent served also to catalyze the crosslinking reaction.

An organic phase comprised of a solution of 20.00 g of copoly[3-(2-cyanoacetamido)phenyl methacrylate:styrene:butyl acrylate] 10:70:20 (wt %), 5.00 g of 1:1 Regal 300:Pliotone 4003, 0.156 g of 2-phenyl-2-imidazoline (charge control agent and catalyst) and 142.00 g of ethyl acetate was prepared. An aqueous phase comprised of 375 ml of pH 10 borate buffer, and 40 ml of a latex (3.0% solids) comprised of butyl methacrylate/ 2-hydroxyethyl methacrylate/ methacrylic acid/ethylene dimethacrylate in a weight ratio of 58/30/5/7 was prepared. Butyraldehyde (0.29 g) was added to the organic phase and both phases were combined and homogenized in a high shear mixer and then sized at 40 psi and collected in a three neck flask. The mixture was stirred overnight with a nitrogen sweep allowing the ethyl acetate to evaporate. The mixture was further stirred for 30 minutes under water aspirator pressure. The mixture was filtered through a coarse screen and collected on a fine fritted funnel. The polymer particles were washed with distilled water until the washes were neutral and the conductivity was <10 $\mu$S/cm. The yield of particles after drying was 20.5 g. The particles were uneffected by ethyl acetate indicating that the particles were crosslinked.

The particles were determined to have a number of average particle size of 6.1$\mu$ and a volume average particle size of 6.4$\mu$. Developer was prepared with lanthanum doped conductive ferrite carrier coated with 2 pph Kynar 301F and 6% toner concentration. The fresh charge (2 min wrist shake) of the toner was measured to be 52 $\mu$C/g and the 5 min exercised charge (bottle brush) was determined to be 53 $\mu$C/g. A sample of toner was laid down onto a paper receiver sheet and oven fused at 135° C. for 15 sec. The resultant fused toner patch adhered well to the receiver.

The invention has been described in detail with particular reference to preferred embodiments thereof, but it will be understood that variations and modifications can be effected within the spirit and scope of the invention.

I claim:

1. An electrostatographic developer containing toner particles comprising a polymer having from 0.1 to 100 weight percent of (2-cyanoacetamido)phenyl acrylate repeating units.

2. The developer of claim 1 wherein the polymer has repeating units according to the following formula (II):

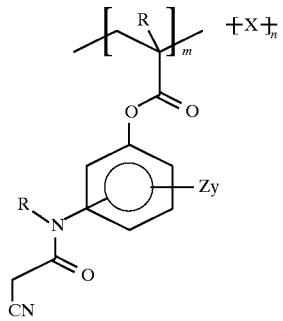

(II)

wherein

R represents H and alkyl and the 2-cyanoacetamido group is ortho, meta or para substituted on the phenyl ring relative to the acrylate group; and Z represents H, alkyl, alkoxy, halo, nitro, alkylsulfonyl, carboxyl, carboalkoxy, cyano, acyl, trihaloalkyl, and aryl; or Z represents sufficient carbon atoms, together with the phenyl ring to which it is attached, to form naphthyl;

X represents a polymerized vinyl monomer;

y is an integer from 0 to 4;

m is from 0.1 to 100 weight percent; and n is from 0 to 99.9 weight percent.

3. The developer of claim 2 wherein R represents methyl, ethyl and propyl; Z represents methyl, ethyl, hydrogen, methoxy, ethoxy, chloro, bromo, fluoro, nitro, ethylsulfonyl, carbomethoxy, carboxyl, cyano, trifluoromethyl, phenyl and acetyl.

4. The developer of claim 1 wherein the polymer is selected from the group consisting of poly[2-(2-cyanoacetamido)phenyl methacrylate], poly[3-(2-cyanoacetamido)phenyl methacrylate], poly[4-(2-cyanoacetamido)phenyl methacrylate], copoly[2-(2-cyanoacetamido)phenyl methacrylate:methyl methacrylate] 10:90 (wt %), copoly[3-(2-cyanoacetamido)phenyl methacrylate:methyl methacrylate] 10:90 (wt %), copoly[4-(2-cyanoacetamido)phenyl methacrylate:methyl methacrylate] 10:90 (wt %), copoly[3-(2-cyanoacetamido)phenyl methacrylate:styrene:butyl acrylate] 5:75:20 (wt %), and copoly [3-(2-cyanoacetamido)phenyl methacrylate:styrene:butyl acrylate] 10:70:20 (wt %).

* * * * *